US007383777B2

(12) United States Patent
Theurer et al.

(10) Patent No.: US 7,383,777 B2
(45) Date of Patent: Jun. 10, 2008

(54) TRACK TAMPING MACHINE

(75) Inventors: Josef Theurer, Vienna (AT); Friedrich Peitl, Linz (AT)

(73) Assignee: Franz Plasser Bahnbaumashinen-Industriegesellschaft mbH, Vienna (AT)

( * ) Notice: Subject to any disclaimer, the term of this patent is extended or adjusted under 35 U.S.C. 154(b) by 0 days.

(21) Appl. No.: 11/827,838

(22) Filed: Jul. 13, 2007

(65) Prior Publication Data

US 2007/0283836 A1 Dec. 13, 2007

Related U.S. Application Data

(63) Continuation of application No. PCT/EP2005/050379, filed on Jan. 31, 2005.

(51) Int. Cl.
*E01B 27/00* (2006.01)

(52) U.S. Cl. ..... 104/12

(58) Field of Classification Search ..... 104/12, 104/2, 10, 11

See application file for complete search history.

(56) References Cited

U.S. PATENT DOCUMENTS 4,576,095 A * 3/1986 Theurer ..... 104/12
5,007,349 A * 4/1991 Theurer ..... 104/12
5,127,334 A * 7/1992 Theurer ..... 104/12
5,269,226 A * 12/1993 Theurer et al. ..... 104/12
5,515,788 A * 5/1996 Theurer et al. ..... 104/12
5,752,447 A * 5/1998 Theurer et al. ..... 104/12

FOREIGN PATENT DOCUMENTS

EP 0 564 433 A1 10/1993
GB 2 267 304 A 12/1993

* cited by examiner

*Primary Examiner*—Mark T. Le
(74) *Attorney, Agent, or Firm*—Laurence A. Greenberg; Werner H. Stemer; Ralph E. Locher

(57) ABSTRACT

A track tamping machine has a machine frame extending in a longitudinal direction and tamping units mounted to the machine frame. A first or upper transverse guide extends in a transverse direction perpendicularly to the longitudinal direction. Two sliding blocks are mounted for displacement in the transverse direction independently of one another on the upper transverse guide. A second or lower transverse guide is positioned vertically below the upper transverse guide and parallel thereto. The lower transverse guide is mounted in the sliding blocks for displacement relative thereto in the transverse direction. Two inner unit frames are connected to a respective one of the sliding blocks and support a tamping unit in each case. Two outer unit frames are positioned in each case farther from a vertical machine center line—with regard to the transverse direction—than an adjacent one of the inner unit frames and support a respective tamping unit. The outer unit frames are mounted on the lower transverse guide for displacement in the transverse direction independently of one another. Transverse drives are provided for independent transverse displacement of the sliding blocks, or the inner unit frames, along the upper transverse guide, and displacement drives are provided for independent transverse displacement of the outer unit frames along the lower transverse guide.

4 Claims, 1 Drawing Sheet

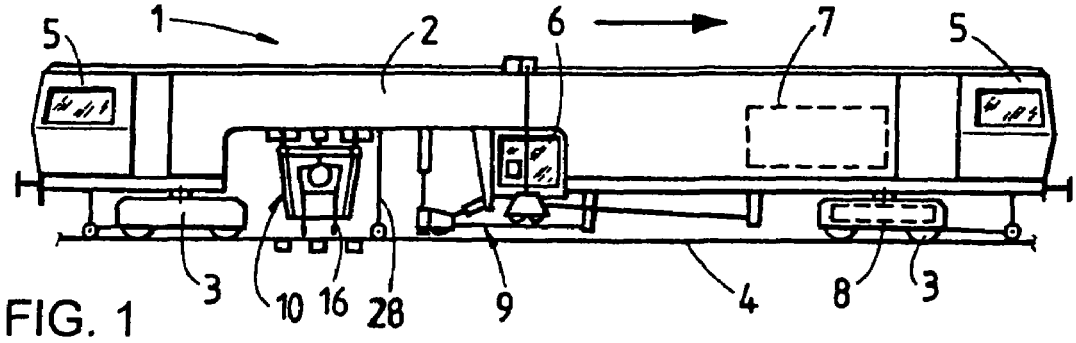
FIG. 1
FIG. 2
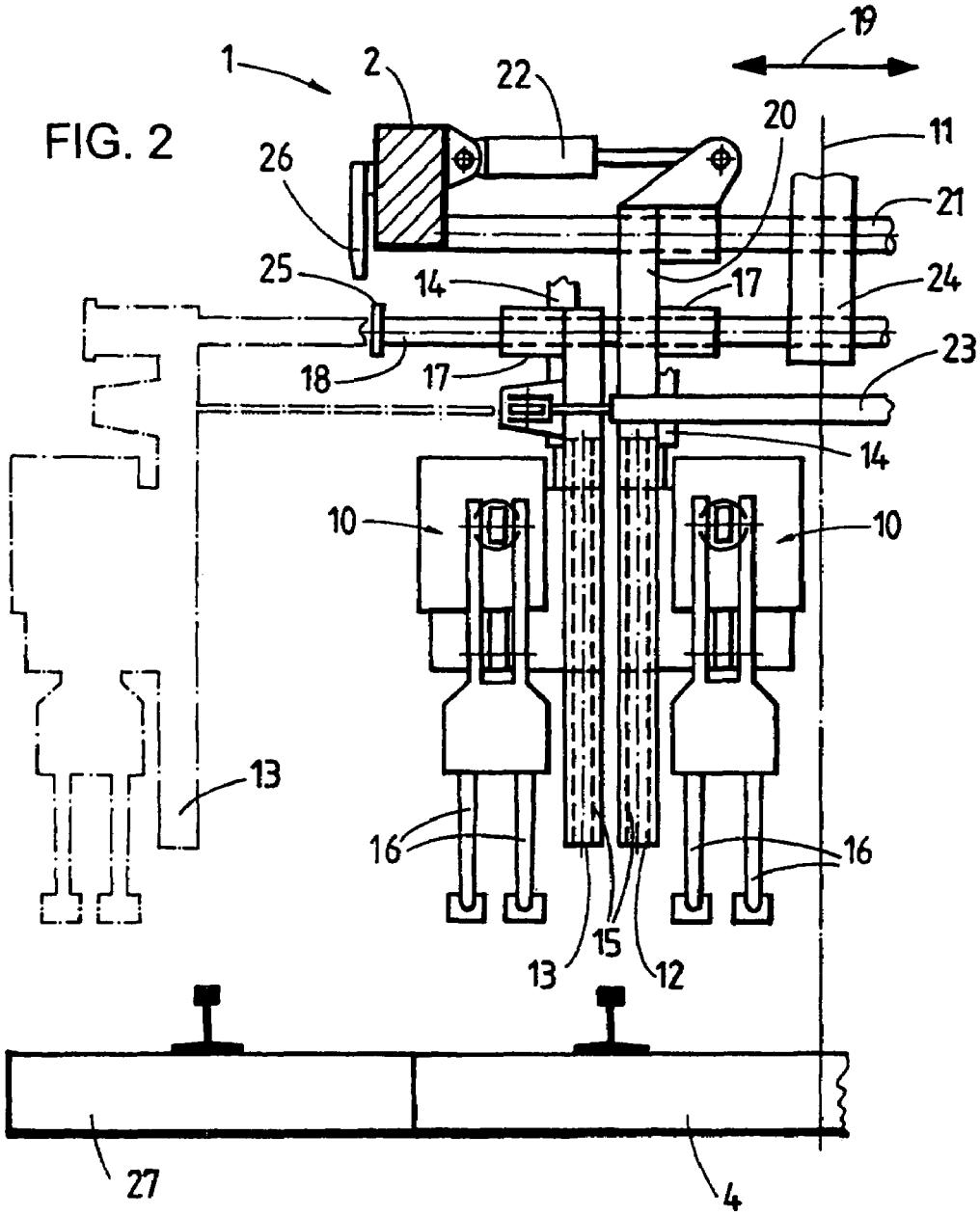

TRACK TAMPING MACHINE

CROSS-REFERENCE TO RELATED APPLICATION

This is a continuing application, under 35 U.S.C. § 120, of copending international application No. PCT/EP2005/050379, filed Jan. 31, 2005, which designated the United States; the prior application is herewith incorporated by reference in its entirety.

BACKGROUND OF THE INVENTION

Field of the Invention

The present invention relates, in general, to a track tamping machine having a machine frame extending in a longitudinal direction and tamping units mounted on the machine frame.

A track tamping machine of the afore-mentioned type is known from British patent specification GB 2 267 304. There, the tamping machine is equipped with tamping units mounted on four unit frames which are displaceable transversely to the longitudinal direction independently of one another on upper and lower transverse guides. The disclosed configuration allows a transverse displacement over a particularly great range. As a result, it is possible with this machine to tamp even track sections which are characterized by an irregular course of the rails. In order to be able to displace the two outer unit frames over the greatest possible distance, the upper and lower transverse guides are displaced together as a unit perpendicularly to the longitudinal direction of the machine. However, to achieve this, a relatively complex structure is required.

SUMMARY OF THE INVENTION

It is an object of the present invention to provide a track tamping machine of the specified kind that overcomes the disadvantages of the heretofore-known machine of this general type, and with which the structural expense required for independent transverse displaceability of the tamping unit frames may be reduced.

With the foregoing and other objects in view there is provided, in accordance with the present invention, a track tamping machine having a machine frame extending in a longitudinal direction and tamping units mounted on the machine frame, the track tamping machine comprising a first or upper transverse guide fastened to the machine frame and extending in a transverse direction perpendicularly to the longitudinal direction, and two sliding blocks mounted for displacement in the transverse direction independently of one another on the upper transverse guide. A second or lower transverse guide is positioned below—with respect to the vertical—the upper transverse guide and parallel thereto the lower transverse guide being mounted in the sliding blocks for displacement relative thereto in the transverse direction. Also provided are two inner unit frames, each being connected to a respective one of the sliding blocks and supporting a tamping unit, and two outer unit frames, each being positioned farther from a vertical machine center line—with regard to the transverse direction—than an adjacent one of the inner unit frames and supporting a tamping unit, with the outer unit frames being mounted on the lower transverse guide for displacement independently of one another. Transverse drives are provided for independent transverse displacement of the sliding blocks, or the inner unit frames, along the upper transverse guide, and displacement drives are provided for independent transverse displacement of the outer unit frames along the lower transverse guide.

As a result of this structural solution according to the invention, the lower transverse guide is supported with the aid of the two inner unit frames. Thus, with a transverse displacement of one of the two outer unit frames, the lower transverse guide can be moved along automatically for the purpose of extending the displacement path or range of said outer unit frame. In the process, a shortening of the displacement path of the second, oppositely positioned outer unit frame is inevitable. This does not present a problem at all, as the latter is to be employed in the switch section within the main track.

Other features which are considered as characteristic for the invention are set forth in the appended claims.

Although the invention is illustrated and described herein as embodied in a track tamping machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 1 is a side view of a track tamping machine; and

FIG. 2 is a cross-section of the machine, wherein only a left-hand half of tamping units arranged symmetrically with regard to a vertical machine center line is illustrated.

DETAILED DESCRIPTION OF THE INVENTION

Referring now to the figures of the drawing in detail and first, particularly, to FIG. 1 thereof, there is shown a track tamping machine 1 comprising an elongated, bridge-shaped machine frame 2 extending in a longitudinal direction. The machine frame 2 is mobile by means of on-track undercarriages 3 on a track 4 and includes driver's cabs 5, arranged at the ends, and a work cabin 6 which is arranged centrally. A power unit 7 serves for actuation of a motive drive 8 of the machine 1 and of a track lifting unit 9, supported on the machine frame 2 and equipped with an auxiliary lifting unit, and also of tamping units 10. These are arranged immediately following the track lifting unit 9 in a working direction indicated by an arrow and include a pair of tamping tools 16 in each case. A leveling and lining reference system 28 is provided for controlling the working units during operation of the machine 1. In order to be able to employ the track tamping machine 1 to good effect also in switch- and crossing regions, the tamping units 10 are mounted for displacement in the transverse direction of the machine, as will be described in more detail in FIG. 2.

In accordance with the already mentioned symmetrical arrangement, there are provided two inner unit frames 12, situated nearer to a vertical machine center line 11 in each case, and two outer unit frames 13 (only the left-hand unit frame 12, 13 is shown in each case in FIG. 2). Supported on each of the total of four unit frames 12, 13 is a respective tamping unit 10 which is independently vertically adjustable on vertical guides 15 by means of drives 14 and comprises tamping tools 16.

A guiding sleeve 17 is associated with each unit frame 12, 13. The latter are thereby supported on lower transverse guides 18 (of which only the front one is visible) for displacement in a transverse direction 19 extending perpendicularly to the longitudinal direction of the machine 1. Each inner unit frame 12 is connected, in the region of its guiding sleeve 17, to a sliding block 20 which is displaceably supported on an upper (with respect to a vertical) transverse guide 21 extending in the transverse direction 19. For independent displacement in said transverse direction 19, each inner unit frame 12 is connected to a respective transverse drive 22 fastened to the machine frame 2. Each of the outer unit frames 13 is independently displaceable along the lower transverse guides 18 with the aid of a respective displacement drive 23 which is articulated on the machine frame 2.

The upper transverse guide 21 is connected at each end to the machine frame 2 and also supported at the centre. Each of the lower transverse guides 18 is supported, on the one hand, on the upper transverse guide 21 by means of the sliding blocks 20 (of which only the one on the left is shown) and, on the other hand, on a support 24 connected in the middle to the machine frame 2, and is freely movable relative thereto in the transverse direction 19. A respective stop 25 is provided at the ends of each lower transverse guide 18. A further, vertically adjustable safety stop 26, connected to the machine frame 2, serves for fixing or arresting the lower transverse guides 18 in their position during transfer travel.

For tamping a normal section of a track 4 on which the track tamping machine 1 travels, the (total of four) tamping units 10 with their respective unit frames 12, 13 are in the position shown in FIG. 2 in solid lines. For tamping a switch section 27 leading away from the track 4 or the machine 1, the outer unit frame 13 located on the same side as the switch section is displaced transversely along the lower transverse guides 18 with actuation of the displacement drive 23. In doing so, after the sliding sleeve 17 makes contact with the stop 25, each lower transverse guide 18 is transversely displaced still further, together with the outer unit frame 13, in order to finally bring the associated tamping unit 10 into the outermost position (shown in dash-and-dotted lines) for tamping the outermost part of the switch section 27.

Parallel thereto, the adjoining inner unit frame 12 is also displaced with the aid of the associated transverse drive 22 in the direction of the switch section 27, during which the outwardly projecting lower transverse guide 18 is supported by means of the sliding block 20 which is displaced along with it. Also parallel thereto, the displacement- and transverse drives 23, 22 which lie opposite in the transverse direction 19 are switched pressureless so that the two unit frames 12, 13 spaced farther from the switch section 27 are automatically displaced along with the displacement of the lower transverse guide 18.

The invention claimed is:

1. A track tamping machine, comprising:

a machine frame extending in a longitudinal direction and defining a vertical machine center line;

an upper transverse guide fastened to said machine frame and extending in a transverse direction substantially perpendicularly to the longitudinal direction;

two sliding blocks mounted for displacement in the transverse direction independently of one another on said upper transverse guide;

a lower transverse guide disposed below, with regard to a vertical, said upper transverse guide and extending parallel to said upper transverse guide, said lower transverse guide being mounted in said sliding blocks for displacement relative thereto in the transverse direction;

two inner unit frames each connected to a respective one of said sliding blocks and supporting a tamping unit;

two outer unit frames each positioned farther from the vertical machine center line, with regard to the transverse direction, than an adjacent one of said inner unit frames and supporting a tamping unit, said outer unit frames being mounted on said lower transverse guide for displacement in the transverse direction independently of one another;

transverse drives for independent transverse displacement of said sliding blocks, or said inner unit frames, along said upper transverse guide; and displacement drives for independent transverse displacement of said outer unit frames along said lower transverse guide.

2. The track tamping machine of claim 1, which further comprises a support connected to said machine frame and disposed between said two sliding blocks, wherein said lower transverse guide is mounted in said support for displacement in the transverse direction.

3. The track tamping machine of claim 1, which further comprises a stop disposed at an end of said lower transverse guide for limiting a displacement path of said outer unit frame.

4. The track tamping machine of claim 1, which further comprises a safety stop connected to said machine frame and provided for blocking a displaceability of said lower transverse guide in the transverse direction.

* * * * *